US011538388B2

(12) United States Patent
Zhu

(10) Patent No.: US 11,538,388 B2
(45) Date of Patent: Dec. 27, 2022

(54) DISPLAY PANEL, LIGHT REGULATION DEVICE AND LIGHT REGULATION METHOD THEREOF

(71) Applicant: BOE TECHNOLOGY GROUP CO., LTD., Beijing (CN)

(72) Inventor: Wenxiu Zhu, Beijing (CN)

(73) Assignee: Beijing BOE Technology Development Co., Ltd., Beijing (CN)

( * ) Notice: Subject to any disclaimer, the term of this patent is extended or adjusted under 35 U.S.C. 154(b) by 0 days.

(21) Appl. No.: 17/330,510

(22) Filed: May 26, 2021

(65) Prior Publication Data

US 2022/0051603 A1 Feb. 17, 2022

(30) Foreign Application Priority Data

Aug. 17, 2020 (CN) ..... 202010823893.5

(51) Int. Cl.
*G09G 3/20* (2006.01)

(52) U.S. Cl.
CPC ..... *G09G 3/2003* (2013.01); *G09G 3/2074* (2013.01); *G09G 2300/0443* (2013.01); *G09G 2320/0242* (2013.01); *G09G 2320/0626* (2013.01); *G09G 2360/147* (2013.01)

(58) Field of Classification Search
CPC ... G09G 2300/0443; G09G 2300/0452; G09G 2320/0242; G09G 2320/0626; G09G 2360/147; G09G 3/2003; G09G 3/2074
See application file for complete search history.

(56) References Cited

U.S. PATENT DOCUMENTS

2015/0185379 A1* 7/2015 Hui ..... G02F 1/133514 359/891
2019/0213948 A1* 7/2019 Sun ..... H01L 51/5271
2020/0026899 A1* 1/2020 Sun ..... H01L 27/3272
2020/0035199 A1* 1/2020 Zhu ..... G09G 5/10
2021/0295076 A1* 9/2021 Li ..... G06V 40/40

* cited by examiner

*Primary Examiner* — Kenneth Bukowski
(74) *Attorney, Agent, or Firm* — Xsensus LLP

(57) ABSTRACT

A light regulation method is described that includes: obtaining actual brightness of light of a first color in a pixel unit, based on brightness and color coordinate of a pinhole light-emitting area, brightness and color coordinate of a first sub-pixel light-emitting area in the pixel unit, and relative position information of the pinhole light-emitting area and the pixel unit; obtaining standard brightness of the light of the first color in the pixel unit under a preset gray-scale white balance, based on the color coordinates of the first sub-pixel light-emitting area, a second sub-pixel light-emitting area and a third sub-pixel light-emitting area; and comparing the actual brightness with the standard brightness of the pixel unit, and changing the brightness of the first sub-pixel light-emitting area until the actual brightness of the light of the first color in the pixel unit is equal to the standard brightness of the light of the first color.

20 Claims, 3 Drawing Sheets

DISPLAY PANEL, LIGHT REGULATION DEVICE AND LIGHT REGULATION METHOD THEREOF

CROSS-REFERENCE TO RELATED APPLICATION

This application is based upon, and claims the benefit of and priority to, Chinese Patent Application No. 202010823893.5, filed Aug. 17, 2020, the entire contents of which are incorporated herein by reference.

TECHNICAL FIELD

The present disclosure relates to the field of display technology and, more particularly, to a display panel, a light regulation device, and light regulation method thereof.

BACKGROUND

In a display panel of the related art, the display panel has a sensor for fingerprint recognition arranged at the bottom of the display panel. A pinhole is provided in a black matrix area of a color filter substrate in the display panel, and the pinhole is filled with a green light-transmitting material. The light emitted by the display panel may be reflected on a finger, so as to be transmitted to the sensor for fingerprint recognition through the pinhole. However, during a display stage of the display panel, the pinhole may leak green light, which causes a color shift phenomenon of the display panel.

It should be noted that the information disclosed in the background section above is only used to enhance the understanding of the background of the present disclosure, and therefore may include information that does not constitute the prior art known to those of ordinary skill in the art.

SUMMARY

An object of the present disclosure is to provide a light regulation device and light regulation method for a display panel, a display panel, and a driving method thereof.

Other characteristics and advantages of the disclosure will become apparent through the following detailed description, or be learned differently through the practice of the disclosure.

According to an aspect of the present disclosure, there is provided a light regulation method for a display panel, the display panel comprising a pinhole light-emitting area, and a first sub-pixel light-emitting area, a second sub-pixel light-emitting area, and a third sub-pixel light-emitting area of different colors, wherein a light-emitting color of the pinhole light-emitting area and a light-emitting color of the first sub-pixel light-emitting area are both a first color, the light regulation method including:

obtaining brightness and a color coordinate of the pinhole light-emitting area, brightness and a color coordinate of the first sub-pixel light-emitting area in any pixel unit around the pinhole light-emitting area, and color coordinates of the second sub-pixel light-emitting area and the third sub-pixel light-emitting area in the pixel unit;

obtaining actual brightness of light of the first color in the pixel unit, based on the brightness and color coordinate of the pinhole light-emitting area, the brightness and color coordinate of the first sub-pixel light-emitting area in the pixel unit, and relative position information of the pinhole light-emitting area and the pixel unit;

obtaining standard brightness of the light of the first color in the pixel unit under a preset gray-scale white balance, based on the color coordinates of the first sub-pixel light-emitting area, the second sub-pixel light-emitting area and the third sub-pixel light-emitting area;

comparing the actual brightness with the standard brightness of the pixel unit, changing the brightness of the first sub-pixel light-emitting area based on a magnitude relationship between the actual brightness and the standard brightness, and reacquiring the actual brightness of the light of the first color in the pixel unit, until the actual brightness of the light of the first color in the pixel unit is equal to the standard brightness of the light of the first color; and obtaining target brightness of the first sub-pixel light-emitting area under the preset gray-scale, wherein the target brightness of the first sub-pixel light-emitting area is the brightness of the first sub-pixel light-emitting area when the actual brightness of the light of the first color in the pixel unit is equal to the standard brightness of the light of the first color thereof.

According to an aspect of the present disclosure, there is provided a light regulation device for a display panel. The display panel includes a pinhole light-emitting area, and a first sub-pixel light-emitting area, a second sub-pixel light-emitting area and a third sub-pixel light-emitting area of different colors, wherein a light-emitting color of the pinhole light-emitting area and a light-emitting color of the first sub-pixel light-emitting area are both a first color. The light regulation device includes an acquisition module and a processing module. The acquisition module is configured to obtain brightness and a color coordinate of the pinhole light-emitting area, brightness and a color coordinate of the first sub-pixel light-emitting area in any pixel unit around the pinhole light-emitting area, and color coordinates of the second sub-pixel light-emitting area and the third sub-pixel light-emitting area in the pixel unit. The processing module is configured to: obtain actual brightness of light of the first color in the pixel unit, based on the brightness and color coordinate of the pinhole light-emitting area, the brightness and color coordinate of the first sub-pixel light-emitting area in the pixel unit, and relative position information of the pinhole light-emitting area and the pixel unit; obtain standard brightness of the light of the first color in the pixel unit under a preset gray-scale white balance, based on the color coordinates of the first sub-pixel light-emitting area, the second sub-pixel light-emitting area and the third sub-pixel light-emitting area; compare the actual brightness with the standard brightness of the pixel unit, change the brightness of the first sub-pixel light-emitting area based on a magnitude relationship between the actual brightness and the standard brightness, and reacquire the actual brightness of the light of the first color in the pixel unit, until the actual brightness of the light of the first color in the pixel unit is equal to the standard brightness of the light of the first color thereof; and obtain target brightness of the first sub-pixel light-emitting area under the preset gray-scale, wherein the target brightness of the first sub-pixel light-emitting area is the brightness of the first sub-pixel light-emitting area when the actual brightness of the light of the first color in the pixel unit is equal to the standard brightness of the light of the first color thereof.

According to an aspect of the present disclosure, there is provided a driving method for a display device, including:

obtaining a gray-scale of a first sub-pixel light-emitting area in any pixel unit around a pinhole light-emitting area;

obtaining a target brightness of the first sub-pixel light-emitting area based on the gray-scale of the first sub-pixel light-emitting area; and driving the first sub-pixel light-emitting area to emit light based on the target brightness of the first sub-pixel light-emitting area, wherein the target brightness of the first sub-pixel light-emitting area in the pixel unit is obtained by using the above light regulation method for the display panel.

According to an aspect of the present disclosure, there is provided a display panel, which is driven by using the above driving method for the display device.

It is to be understood that both the foregoing general description and the following detailed description are exemplary and explanatory only and are not restrictive of the present disclosure.

BRIEF DESCRIPTION OF THE DRAWINGS

The drawings herein, which are incorporated in and constitute a part of this specification, illustrate embodiments consistent with the present disclosure, and serve to explain the principles of the present disclosure together with the description. Understandably, the drawings in the following description are just some embodiments of the present disclosure. For those of ordinary skill in the art, other drawings may be obtained based on these drawings without creative efforts.

DETAILED DESCRIPTION

Figure 1:
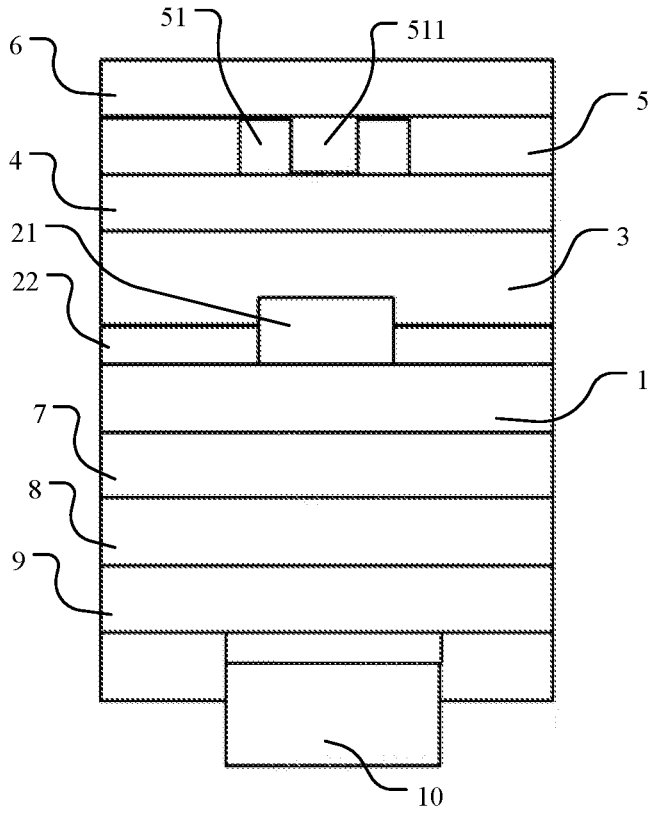
FIG. 1 is a cross-sectional view of a display panel in the related art.

Example embodiments will now be described more fully with reference to the accompanying drawings. However, the example embodiments can be implemented in various forms and should not be construed as limited to the embodiments set forth herein; rather, these embodiments are provided so that the disclosure will be more thorough and complete, and will fully convey the concept of the example embodiments to those skilled in the art. The same reference numerals in the drawings denote the same or similar structures, and thus their detailed descriptions will be omitted.

Although relative terms such as "up" and "down" are used in this specification to describe the relative relationship between one component illustrated in the drawings and another component, these terms are used in this specification for convenience only, for example, according to the illustrative direction depicted in the drawings. It can be understood that if the device illustrated in the drawings is inversed and turned upside down, the component described "above" would become the component "below". Other relative terms, such as "high", "low", "top", "bottom", "left", "right", and the like, also have similar meanings. When a structure is "on" other structure(s), it may mean that the structure is integrally formed on the other structure(s), or that the structure is "directly" arranged on the other structure(s), or that the structure is "indirectly" arranged on other structure(s) through another structure.

The terms "a", "an", and "the" are used to indicate the presence of one or more elements/components/etc.; and the terms "comprising" and "including" are used to mean open-ended inclusion and mean that there may be other elements/components/etc. besides the listed elements/components/etc.

Figure 2:
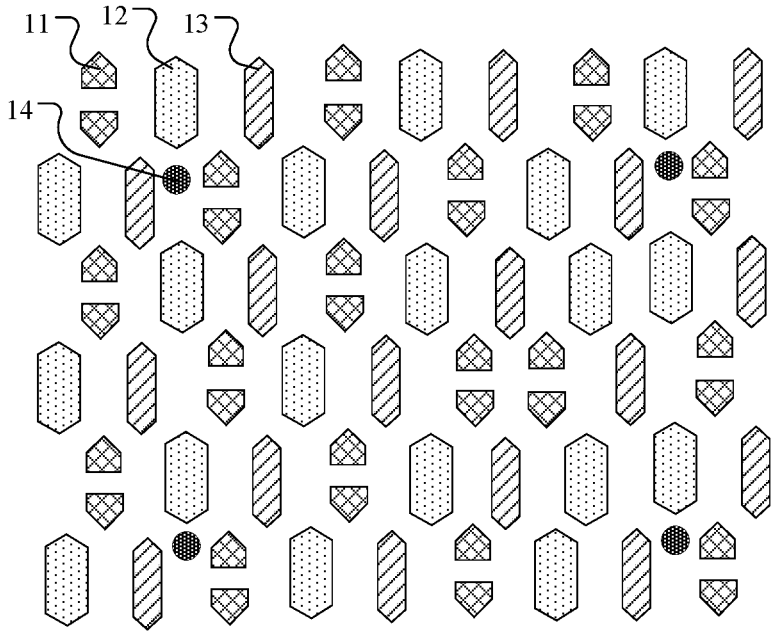
FIG. 2 is a top view of a display panel in the related art.

As shown in FIGS. 1 and 2, FIG. 1 is a cross-sectional view of a display panel in the related art, and FIG. 2 is a top view of a display panel in the related art. As shown in FIG. 1, the display panel may include: an array substrate 1; a pixel defining layer 21 on a side of the array substrate 1; a light emitting unit layer 22 in an opening of the pixel defining layer 21; an encapsulation layer 3 on a side of the light emitting unit layer away from the array substrate 1; a touch layer 4 on a side of the encapsulation layer 3 away from the array substrate 1; a color filter substrate 5 on a side of the touch layer 4 away from the array substrate 1; a cover glass 6 on a side of the color filter substrate 5 away from the array substrate 1; a PI base 7 on the other side of the array substrate 1; a pressure sensitive adhesive layer 8 on a side of the PI base 7 away from the array substrate 1; a bottom film 9 on a side of the pressure sensitive adhesive layer 8 away from the array substrate 1; and a fingerprint sensor 10 on a side of the bottom film 9 away from the array substrate 1. The color filter substrate 5 is provided with a pinhole 511 in a black matrix area 51, and the pinhole is filled with a green light-transmitting material. The light emitted by the light emitting unit layer 22 may be reflected on a finger, so as to be transmitted to the fingerprint sensor 10 through the pinhole 511. As shown in FIG. 2, a pixel structure of the display panel may be a GGRB structure, and the display panel may include a plurality of first sub-pixel light-emitting areas 11, a plurality of second sub-pixel light-emitting areas 12, and a plurality of third sub-pixel light-emitting areas 13. The second sub-pixel light-emitting areas 12, the first sub-pixel light-emitting areas 11, and the third sub-pixel light-emitting areas 13 are alternately arranged along the same row. In the same row of pixel light-emitting areas, two first sub-pixel light-emitting areas 11 distributed along a column direction are arranged between the second sub-pixel light-emitting area 12 and the third sub-pixel light-emitting area 13. In adjacent rows of pixel light-emitting areas, the pixel light-emitting areas of the same color are not located in the same column, and in two rows of pixel light-emitting areas spaced one row apart, the pixel light-emitting areas of the same color are located in the same column. There may be a plurality of pinholes 511, and each pinhole 511 may form a pinhole light-emitting area 14. The pinhole light-emitting area 14 may be arranged between the first sub-pixel light-emitting area 11, the second sub-pixel light-emitting area 12 and the third sub-pixel light-emitting area 13. During a display stage of the display panel, the pinhole may leak green light, which causes a color shift phenomenon of the display panel.

Figure 3:
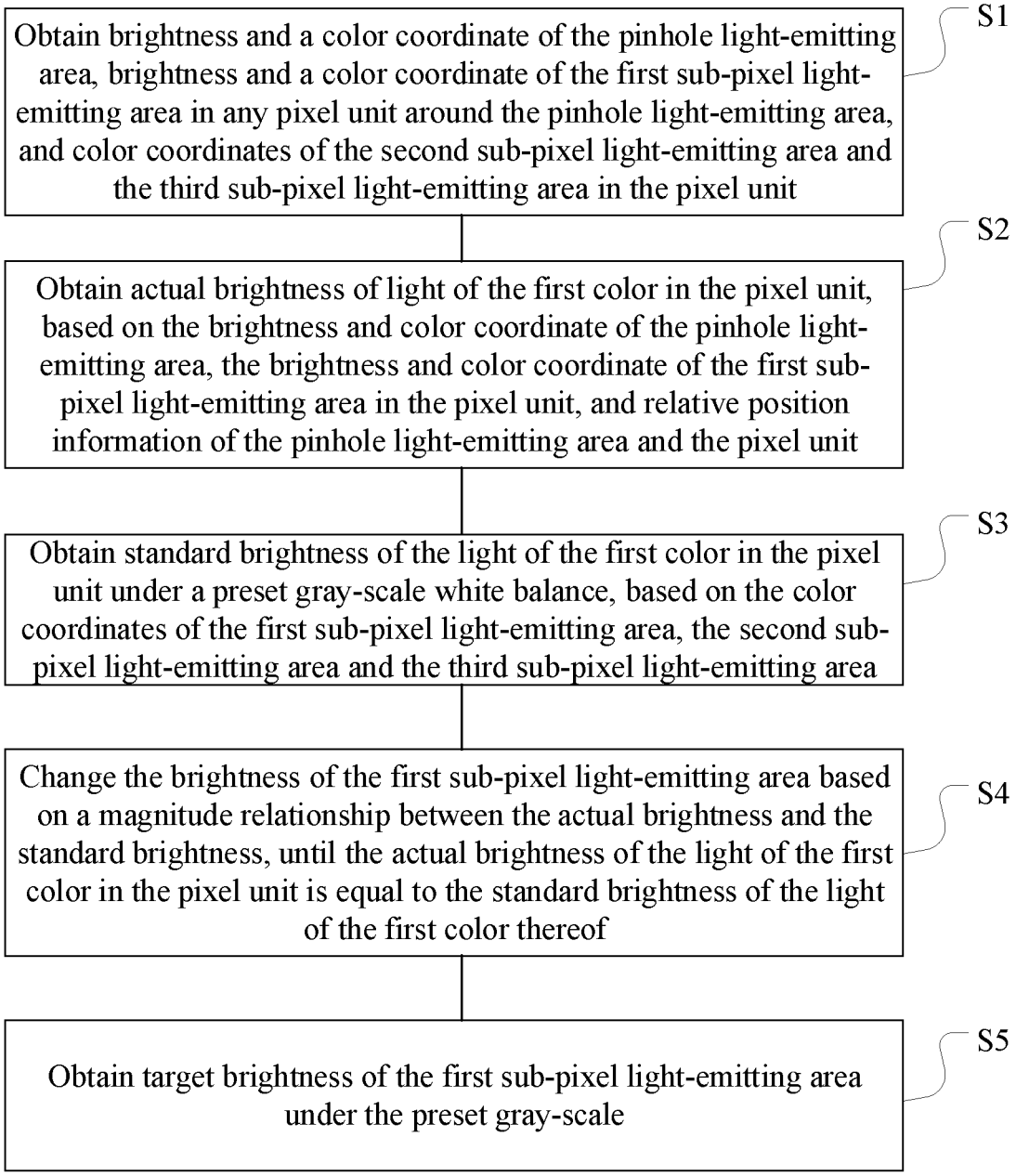
FIG. 3 is a flowchart in an exemplary embodiment of a light regulation method for a display panel of the present disclosure.

Based on this, the exemplary embodiment provides a light regulation method for a display panel. The display panel includes a pinhole light-emitting area, and a first sub-pixel light-emitting area, a second sub-pixel light-emitting area and a third sub-pixel light-emitting area of different colors, wherein a light-emitting color of the pinhole light-emitting area and a light-emitting color of the first sub-pixel light-emitting area are both a first color. As shown in FIG. 3, which is a flowchart in an exemplary embodiment of a light regulation method for a display panel of the present disclosure, the light regulation method may include:

step S1: obtaining brightness and a color coordinate of the pinhole light-emitting area, brightness and a color coordinate of the first sub-pixel light-emitting area in any pixel unit around the pinhole light-emitting area, and color coordinates of the second sub-pixel light-emitting area and the third sub-pixel light-emitting area in the pixel unit;

step S2: obtaining actual brightness of light of the first color in the pixel unit, based on the brightness and color coordinate of the pinhole light-emitting area, the brightness and color coordinate of the first sub-pixel light-emitting area in the pixel unit, and relative position information of the pinhole light-emitting area and the pixel unit;

step S3: obtaining standard brightness of the light of the first color in the pixel unit under a preset gray-scale white balance, based on the color coordinates of the first sub-pixel light-emitting area, the second sub-pixel light-emitting area and the third sub-pixel light-emitting area;

step S4: comparing the actual brightness with the standard brightness of the pixel unit, changing the brightness of the first sub-pixel light-emitting area based on a magnitude relationship between the actual brightness and the standard brightness, and reacquiring the actual brightness of the light of the first color in the pixel unit, until the actual brightness of the light of the first color in the pixel unit is equal to the standard brightness of the light of the first color thereof; and step S5: obtaining target brightness of the first sub-pixel light-emitting area under the preset gray-scale, wherein the target brightness of the first sub-pixel light-emitting area is the brightness of the first sub-pixel light-emitting area when the actual brightness of the light of the first color in the pixel unit is equal to the standard brightness of the light of the first color thereof.

The light regulation method for the display panel provided by the present disclosure adjusts the brightness of the first sub-pixel light-emitting area, so that the brightness of the light of the first color in the pixel unit is equal to the brightness of the light of the first color in the pixel unit under the preset gray-scale white balance. The method can obtain the target brightness of the first sub-pixel light-emitting area under the preset gray-scale. When the gray-scale of the first sub-pixel light-emitting area is the preset gray-scale, the brightness for driving the first sub-pixel light-emitting area is the corresponding target brightness under the gray-scale, such that the color shift phenomenon in the display panel can be avoided.

The above steps are described in detail below.

Figure 4:
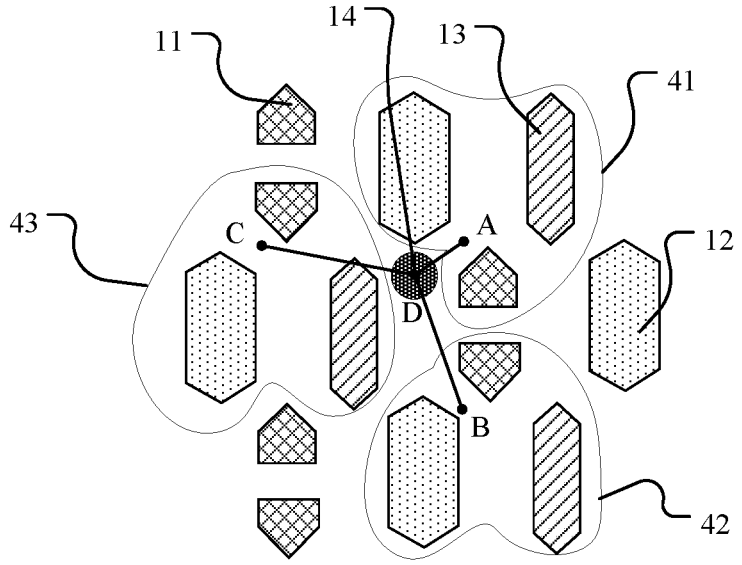
FIG. 4 is a partial enlarged view of FIG. 2.

In the exemplary embodiment, the display panel, which may have a structure as shown in FIGS. 1 and 2, may include the plurality of first sub-pixel light-emitting areas 11, the plurality of second sub-pixel light-emitting areas 12, the plurality of third sub-pixel light-emitting areas 13, and the pinhole light-emitting area 14. The second sub-pixel light-emitting areas 12, the first sub-pixel light-emitting areas 11, and the third sub-pixel light-emitting areas 13 are alternately arranged along the same row. In the same row of pixel light-emitting areas, two first sub-pixel light-emitting areas 11 distributed along a column direction are arranged between the second sub-pixel light-emitting area 12 and the third sub-pixel light-emitting area 13. In adjacent rows of pixel light-emitting areas, the pixel light-emitting areas of the same color are not located in the same column, and in two rows of pixel light-emitting areas spaced one row apart, the pixel light-emitting areas of the same color are located in the same column. There may be a plurality of pinholes 511, and each pinhole 511 may form the pinhole light-emitting area 14. The pinhole light-emitting area 14 may be arranged between the first sub-pixel light-emitting area 11, the second sub-pixel light-emitting area 12 and the third sub-pixel light-emitting area 13. Both the first sub-pixel light-emitting area and the pinhole light-emitting area may emit green light; the second sub-pixel light-emitting area may emit red light; and the third sub-pixel light-emitting area may emit blue light. The green light emitted from the pinhole light-emitting area 14 may affect the brightness of the green light of the surrounding pixel units, thereby causing the color shift of the display panel. As shown in FIG. 4, which is a partial enlarged view of FIG. 2, three pixel units 41, 42 and 43 are distributed around the pinhole light-emitting area 14. The exemplary embodiment takes the brightness adjustment of the pixel unit 41 as an example for description.

It should be understood that, in other exemplary embodiments, the display panel may also have other structures. In other structures, the display panel may also form the pinhole light-emitting area, and the pinhole light-emitting area is located outside the light-emitting area of the pixel unit, such that the color shift phenomenon of the display panel may also be caused. In the exemplary embodiment, the following light regulation method may also be used to solve the color shift phenomenon. In addition, the light-emitting color of the pinhole light-emitting area may also be other colors.

Step S1: the brightness and color coordinate of the pinhole light-emitting area 14, the brightness and color coordinate of the first sub-pixel light-emitting area 11 in the pixel unit 41, and color coordinates of the second sub-pixel light-emitting area 12 and the third sub-pixel light-emitting area 13 in the pixel unit 41 are obtained. The brightness and color coordinate of the pinhole light-emitting area 14 can be obtained by simulation using "Lighttools" software based on position and structure information of the pinhole. The brightness and color coordinates of the first sub-pixel light-emitting area 11, the second sub-pixel light-emitting area 12, and the third sub-pixel light-emitting area 13 in the pixel unit 41 may be obtained through detection.

Step S2: the actual brightness of the green light in the pixel unit 41 is obtained, based on the brightness and color coordinate of the pinhole light-emitting area 14, the brightness and color coordinate of the first sub-pixel light-emitting area 11 in the pixel unit, and the relative position information of the pinhole light-emitting area 14 and the pixel unit 41. In the example embodiment, obtaining the actual brightness of the green light in the pixel unit 41 may include: obtaining a brightness weight of the green light allocated to the pixel unit from the pinhole light-emitting area, based on a distance between a brightness center D of the pinhole light-emitting area 14 and a brightness center A of the pixel unit 41. Based on the brightness weight of the green light allocated to the pixel unit 41 from the pinhole light-emitting area 14 and the brightness of the pinhole light-emitting area 14, the brightness of the green light allocated to the pixel unit 41 is obtained. The color coordinate of the green light allocated to the pixel unit 41 from the pinhole light-emitting area 14 is the same as the color coordinate of the green light of the pinhole light-emitting area; and the actual brightness of the green light in the pixel unit 41 is obtained, based on the brightness and color coordinate of the green light allocated to the pixel unit 41 from the pinhole light-emitting area 14 and the brightness and color coordinate of the first sub-pixel light-emitting area 11 in the pixel unit 41.

In the exemplary embodiment, obtaining a brightness weight of the green light allocated to the pixel unit from the pinhole light-emitting area may include: determining the plurality of pixel units 41, 42 and 43 closest to the pinhole light-emitting area 14; and obtaining the distance s1 between the brightness center D of the pinhole light-emitting area 14 and the brightness center A of the pixel unit 41, a distance s2 between the brightness center D of the pinhole light-emitting area 14 and a brightness center B of the pixel unit 42, and a distance s3 between the brightness center D of the pinhole light-emitting area 14 and a brightness center C of the pixel unit 43, respectively. The distance from the brightness center of the pixel unit 41, 42 or 43 to the brightness center D of the pinhole light-emitting area is proportional to the brightness weight of the green light allocated to the pixel unit. It is approximately considered that the pinhole light-emitting area 14 only affects the brightness of the green light in the three closest pixel units 41, 42 and 43. Therefore, the sum of the brightness weights of the green light allocated to the pixel units 41, 42 and 43 is 1. Thus, the brightness of the green light allocated to the pixel unit 41 can be calculated through s1, s2 and s3. For example, the brightness of the pinhole light-emitting area is Lh, and the brightness of the green light allocated to the pixel unit 41 is Lh*s1/(s1+s2+s3). The brightness center of the pinhole light-emitting area 14 may be the centroid of the pinhole light-emitting area, and the brightness center of the pixel unit may represent the centroid of the light-emitting area formed by the pixel unit. In the exemplary embodiment, in the display panel structure shown in FIG. 4, the brightness center of the pixel unit may be located on a line connecting the centroid of the second sub-pixel light-emitting area 12 and the centroid of the first sub-pixel light-emitting area 11. The distance between the brightness center of the pixel unit and the centroid of the first sub-pixel light-emitting area may be 35/65 times the distance between the brightness center of the pixel unit and the centroid of the second sub-pixel light-emitting area.

It should be understood that in other exemplary embodiments, it can also be approximated that the pinhole light-emitting area 14 also affects the brightness of the green light in the more adjacent pixel units. Correspondingly, the sum of the brightness weights of the green light allocated to the plurality of pixel units is 1, and the distance from the brightness center of the pixel unit to the brightness center of the pinhole light-emitting area is proportional to the brightness weight of the green light allocated to the pixel unit. The plurality of pixel units closest to the pinhole light-emitting area may refer to the plurality of pixel units whose light-emitting center is closest to the light-emitting center of pinhole light-emitting area.

In the exemplary embodiment, the obtaining the actual brightness of the green light in the pixel unit 41 based on the brightness and color coordinate of the green light allocated to the pixel unit 41 from the pinhole light-emitting area 14 and the brightness and color coordinate of the first sub-pixel light-emitting area in the pixel unit 41 may include:

calculating the actual brightness of the green light in the pixel unit 41 according to the following formulae:

$$\begin{pmatrix} L(h) \\ L(g1) \\ L(g2) \end{pmatrix} = \begin{pmatrix} Ghx & G1x & G2x \\ Ghy & G1y & G2y \\ Ghz & G1z & G2z \end{pmatrix}^{-1} = \begin{pmatrix} X1 \\ Y1 \\ Z1 \end{pmatrix}$$

$$Ghx = \frac{xh}{yh};\ Ghy = 1;\ Ghz = \frac{1 - xh - yh}{yh};$$

$$G1x = \frac{x1}{y1};\ G1y = 1;\ G1z = \frac{1 - x1 - y1}{y1};$$

$$G2x = \frac{x1}{y1};\ G2y = 1;\ G2z = \frac{1 - x1 - y1}{y1};$$

where L(h) represents the brightness of the green light allocated to the pixel unit from the pinhole light-emitting area; L(g1) represents the brightness of part of the first sub-pixel light-emitting area, L(g2) represents the brightness of other parts of the first sub-pixel light-emitting area, and the sum of L(g1) and L(g2) is equal to the brightness of the first sub-pixel light-emitting area; (xh, yh) represents the color coordinate of the green light allocated to the pixel unit from the pinhole light-emitting area, that is, the color coordinate of the pinhole light-emitting area; (x1, y1) represents the color coordinate of the first sub-pixel light-emitting area; and X1, Y1 and Z1 represent the tristimulus value of green light in the pixel unit, where Y1 is equal to the actual brightness of the green light in the pixel unit. According to the above matrix operation, the actual brightness of the green light in the pixel unit 41 can be obtained.

Step S3: the standard brightness of the green light in the pixel unit 41 under the preset gray-scale white balance is obtained, based on the color coordinates of the first sub-pixel light-emitting area 11, the second sub-pixel light-emitting area 12 and the third sub-pixel light-emitting area 13 in the pixel unit 41. In the exemplary embodiment, the obtaining the standard brightness of the green light in the pixel unit under the preset gray-scale white balance may include:

calculating the standard brightness of the green light in the pixel unit under the preset gray-scale white balance according to the following formulae:

$$\begin{pmatrix} L(R) \\ L(G) \\ L(B) \end{pmatrix} = \begin{pmatrix} Rx & Gx & Bx \\ Ry & Gy & By \\ Rz & Gz & Bz \end{pmatrix}^{-1} = \begin{pmatrix} X2 \\ Y2 \\ Z2 \end{pmatrix}$$

$$Rx = \frac{xr}{yr};\ Ry = 1;\ Rz = \frac{1 - xr - yr}{yr};$$

$$Gx = \frac{xg}{yg};\ Gy = 1;\ Gz = \frac{1 - xg - yg}{yg};$$

$$Bx = \frac{xb}{yb};\ By = 1;\ Bz = \frac{1 - xb - yb}{yb};$$

where L(R) represents the standard brightness of the second sub-pixel light-emitting area under the preset gray-scale white balance; L(G) represents the standard brightness of the first sub-pixel light-emitting area under the preset gray-scale white balance; L(B) represents the standard brightness of the third sub-pixel light-emitting area under the preset gray-scale white balance; X2, Y2 and Z2 represent the tristimulus value of the preset gray-scale white light; (xr, yr) represents the color coordinate of the second sub-pixel light-emitting area; (xg, yg) represents the color coordinate of the first sub-pixel light-emitting area; and (xb, yb) represents the color coordinate of the third sub-pixel light-emitting area. The tristimulus value of the preset gray-scale white light is known, and it can be obtained through the above matrix operation that, under the preset gray-scale, the standard brightness L(G) of the green light when the color shift phenomenon does not occur in the pixel unit 41.

Step S4: the actual brightness of the pixel unit 41 is compared with the standard brightness of the pixel unit, the brightness of the first sub-pixel light-emitting area 11 is changed based on the magnitude relationship between the actual brightness and the standard brightness, and the actual brightness of the green light in the pixel unit 41 is reacquired, until the actual brightness of the green light in the pixel unit is equal to the standard brightness of the green light thereof.

In the exemplary embodiment, the comparing the actual brightness with the standard brightness of the pixel unit and changing the brightness of the first sub-pixel light-emitting area based on the magnitude relationship between the actual brightness and the standard brightness may include: comparing the actual brightness with the standard brightness of the pixel unit, and gradually increasing or decreasing the brightness of the first sub-pixel light-emitting area according to a preset brightness interval based on the magnitude relationship between the actual brightness and the standard brightness, until the actual brightness of the green light in the pixel unit is equal to the standard brightness of the green light thereof. When the actual brightness is greater than the standard brightness, the brightness of the first sub-pixel light-emitting area is gradually decreased according to the preset brightness interval, until the actual brightness of the green light in the pixel unit is equal to the standard brightness of the green light thereof. When the actual brightness is less than the standard brightness, the brightness of the first sub-pixel light-emitting area is gradually increased according to the preset brightness interval, until the actual brightness of the green light in the pixel unit is equal to the standard brightness of the green light thereof.

In the exemplary embodiment, the reacquiring the actual brightness of the green light in the pixel unit may include: obtaining the changed brightness of the pinhole light-emitting area based on the changed brightness of the first sub-pixel light-emitting area; wherein the initial brightness of the first sub-pixel light-emitting area is L1, and the initial brightness of the pinhole light-emitting area is L2; and the changed brightness of the first sub-pixel light-emitting area is L3, and the changed brightness of the pinhole light-emitting area is L4=L2*L3/L1. Then, the actual brightness of the green light in the pixel unit 41 may be reacquired by the method of the above step S2, until the actual brightness of the green light in the pixel unit 41 is equal to the standard brightness of the green light thereof.

Step S5: the target brightness of the first sub-pixel light-emitting area under the preset gray-scale is obtained, wherein the target brightness of the first sub-pixel light-emitting area is the brightness of the first sub-pixel light-emitting area when the actual brightness of the green light in the pixel unit is equal to the standard brightness of the green light thereof. That is, when the gray-scale of the first sub-pixel light-emitting area is the above preset gray-scale and the brightness for driving the first sub-pixel light-emitting area is the target brightness, the color shift phenomenon does not occur in the pixel unit.

In the exemplary embodiment, the light regulation method may further include obtaining the target brightness of the first sub-pixel light-emitting area under a plurality of gray-scales, and obtaining the target brightness of the first sub-pixel light-emitting area under any gray-scale by using interpolation method. Therefore, in any gray-scale, a certain driving voltage can be applied to the sub-pixel unit where the first sub-pixel light-emitting area is located so that the first sub-pixel light-emitting area presents the target brightness, such that no color shift occurs in the pixel unit where the first sub-pixel light-emitting area is located.

It should be understood that the exemplary embodiment may also use the above light regulation method to perform light regulation on other pixel units. For example, the same light regulation method may be used to perform light regulation on the pixel units 42 and 43 in FIG. 4.

Figure 5:
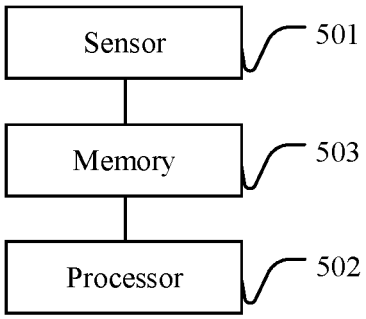
FIG. 5 is a schematically structural view of a light regulation device for a display panel of the present disclosure.

An exemplary embodiment of the present disclosure further provides a light regulation device for a display panel, as shown in FIG. 5, which is a schematically structural view of a light regulation device for a display panel of the present disclosure. The display panel includes a pinhole light-emitting area, and a first sub-pixel light-emitting area, a second sub-pixel light-emitting area and a third sub-pixel light-emitting area of different colors, wherein a light-emitting color of the pinhole light-emitting area and a light-emitting color of the first sub-pixel light-emitting area are both a first color. The light regulation device includes a sensor 501, a processor 502 and a memory 503. The sensor 501 is configured to obtain brightness and a color coordinate of the pinhole light-emitting area, brightness and a color coordinate of the first sub-pixel light-emitting area in any pixel unit around the pinhole light-emitting area, and color coordinates of the second sub-pixel light-emitting area and the third sub-pixel light-emitting area in the pixel unit. The processor 502 is configured to, through executing a program stored in the memory 503, obtain actual brightness of light of the first color in the pixel unit, based on the brightness and color coordinate of the pinhole light-emitting area, the brightness and color coordinate of the first sub-pixel light-emitting area in the pixel unit, and relative position information of the pinhole light-emitting area and the pixel unit; obtain standard brightness of the light of the first color in the pixel unit under a preset gray-scale white balance, based on the color coordinates of the first sub-pixel light-emitting area, the second sub-pixel light-emitting area and the third sub-pixel light-emitting area; compare the actual brightness with the standard brightness of the pixel unit, change the brightness of the first sub-pixel light-emitting area based on a magnitude relationship between the actual brightness and the standard brightness, and reacquire the actual brightness of the light of the first color in the pixel unit, until the actual brightness of the light of the first color in the pixel unit is equal to the standard brightness of the light of the first color thereof and obtain target brightness of the first sub-pixel light-emitting area under the preset gray-scale, wherein the target brightness of the first sub-pixel light-emitting area is the brightness of the first sub-pixel light-emitting area when the actual brightness of the light of the first color in the pixel unit is equal to the standard brightness of the light of the first color thereof.

The processor 502 is further configured to obtain the target brightness of the first sub-pixel light-emitting area under any gray-scale by the above light regulation method.

An exemplary embodiment of the present disclosure further provides a driving method for a display device, including:

obtaining a gray-scale of a first sub-pixel light-emitting area in any pixel unit around a pinhole light-emitting area;

obtaining a target brightness of the first sub-pixel light-emitting area based on the gray-scale of the first sub-pixel light-emitting area; and driving the first sub-pixel light-emitting area to emit light based on the target brightness of the first sub-pixel light-emitting area, wherein the target brightness of the first sub-pixel light-emitting area in the pixel unit is obtained by using the above light regulation method for the display panel.

The driving method for the display device may avoid the color shift phenomenon of the display panel.

An exemplary embodiment of the present disclosure further provides a display panel, which may be driven by using the above driving method for the display device. The display panel may be applied to display devices such as mobile phones, TVs, and tablet computers.

After considering the specification and practicing the disclosure disclosed herein, those skilled in the art will easily contemplate other embodiments of the present disclosure. The application is intended to cover any variations, uses, or adaptive changes of the present disclosure. These variations, uses, or adaptive changes follow the general principles of the present disclosure and include the common knowledge or conventional technical means in the technical field not disclosed in the disclosure. The description and the embodiments are only regarded as exemplary, and the true scope and spirit of the present disclosure are pointed out by the claims.

It should be understood that the present disclosure is not limited to the precise structure that has been described above and shown in the drawings, and various modifications and changes can be made without departing from its scope. The scope of the present disclosure is limited only by the appended claims.

What is claimed is:

1. A light regulation method for a display panel, comprising:

providing the display panel, the display panel comprising a pinhole light-emitting area, a first sub-pixel light-emitting area, a second sub-pixel light-emitting area, and a third sub-pixel light-emitting area of different colors, wherein a light-emitting color of the pinhole light-emitting area and a light-emitting color of the first sub-pixel light-emitting area are both a first color;

obtaining brightness and a color coordinate of the pinhole light-emitting area, brightness and a color coordinate of the first sub-pixel light-emitting area in any pixel unit around the pinhole light-emitting area, and color coordinates of the second sub-pixel light-emitting area and the third sub-pixel light-emitting area in the pixel unit;

obtaining actual brightness of light of the first color in the pixel unit, based on the brightness and color coordinate of the pinhole light-emitting area, the brightness and color coordinate of the first sub-pixel light-emitting area in the pixel unit, and relative position information of the pinhole light-emitting area and the pixel unit;

obtaining standard brightness of the light of the first color in the pixel unit under a preset gray-scale white balance, based on the color coordinates of the first sub-pixel light-emitting area, the second sub-pixel light-emitting area and the third sub-pixel light-emitting area;

comparing the actual brightness with the standard brightness of the pixel unit, changing the brightness of the first sub-pixel light-emitting area based on a magnitude relationship between the actual brightness and the standard brightness, and reacquiring the actual brightness of the light of the first color in the pixel unit, until the actual brightness of the light of the first color in the pixel unit is equal to the standard brightness of the light of the first color thereof; and obtaining target brightness of the first sub-pixel light-emitting area under the preset gray-scale, wherein the target brightness of the first sub-pixel light-emitting area is the brightness of the first sub-pixel light-emitting area when the actual brightness of the light of the first color in the pixel unit is equal to the standard brightness of the light of the first color thereof.

2. The method according to claim 1, wherein the obtaining the actual brightness of the light of the first color in the pixel unit based on the brightness and color coordinate of the pinhole light-emitting area, the brightness and color coordinate of the first sub-pixel light-emitting area in the pixel unit, and the relative position information of the pinhole light-emitting area and the pixel unit comprises:

obtaining a brightness weight of the light of the first color allocated to the pixel unit from the pinhole light-emitting area, based on a distance between a brightness center of the pinhole light-emitting area and a brightness center of the pixel unit;

obtaining the brightness of the light of the first color allocated to the pixel unit; based on the brightness weight of the light of the first color allocated to the pixel unit from the pinhole light-emitting area and the brightness of the pinhole light-emitting area, wherein the color coordinate of the light of the first color allocated to the pixel unit from the pinhole light-emitting area is the same as the color coordinate of the light of the first color of the pinhole light-emitting area; and obtaining the actual brightness of the light of the first color in the pixel unit, based on the brightness and color coordinate of the light of the first color allocated to the pixel unit from the pinhole light-emitting area and the brightness and color coordinate of the first sub-pixel light-emitting area in the pixel unit.

3. The method according to claim 2, wherein the obtaining the brightness weight of the light of the first color allocated to the pixel unit from the pinhole light-emitting area based on the distance between the brightness center of the pinhole light-emitting area and the brightness center of the pixel unit comprises:

determining a plurality of pixel units closest to the pinhole light-emitting area;

obtaining the distance between the brightness center of the pinhole light-emitting area and the brightness center of each of the plurality of pixel units respectively; and obtaining the brightness weight of the light of the first color allocated to any one of the plurality of pixel units from the pinhole light-emitting area; based on the distance between the brightness center of the pinhole light-emitting area and the brightness center of each of the plurality of pixel units, wherein the sum of the brightness weights of the light of the first color allocated to the plurality of pixel units is 1, and the distance from the brightness center of the pixel unit to the brightness center of the pinhole light-emitting area is proportional to the brightness weight of the light of the first color allocated to the pixel unit.

4. The method according to claim 2, wherein:

the first sub-pixel light-emitting area is a green light-emitting area, the second sub-pixel light-emitting area is a red light-emitting area, and the third sub-pixel light-emitting area is a blue light-emitting area;

the display panel comprises the plurality of first sub-pixel light-emitting areas, the plurality of second sub-pixel light-emitting areas, and the plurality of third sub-pixel light-emitting areas, the second sub-pixel light-emitting areas, the first sub-pixel light-emitting areas, and the third sub-pixel light-emitting areas are alternately arranged along the same row, in the same row of pixel light-emitting areas, two first sub-pixel light-emitting areas distributed along a column direction are arranged between the second sub-pixel light-emitting area and the third sub-pixel light-emitting area, in adjacent rows of pixel light-emitting areas, the pixel light-emitting areas of the same color are not located in the same column, and in two rows of pixel light-emitting areas spaced one row apart, the pixel light-emitting areas of the same color are located in the same column;

the obtaining the brightness weight of the light of the first color allocated to the pixel unit from the pinhole light-emitting area based on the distance between the brightness center of the pinhole light-emitting area and the brightness center of the pixel unit comprises:

determining three pixel units closest to the pinhole light-emitting area;

obtaining the distance between the brightness center of the pinhole light-emitting area and the brightness center of each of the three pixel units respectively; and obtaining the brightness weight of the light of the first color allocated to any one of the three pixel units from the pinhole light-emitting area, based on the distance between the brightness center of the pinhole light-emitting area and the brightness center of each of the three pixel units, wherein the sum of the brightness weights of the light of the first color allocated to the three pixel units is 1, and the distance from the brightness center of the pixel unit to the brightness center of the pinhole light-emitting area is proportional to the brightness weight of the light of the first color allocated to the pixel unit.

5. The method according to claim 2, wherein the obtaining the brightness of the light of the first color allocated to the pixel unit based on the brightness weight of the light of the first color allocated to the pixel unit from the pinhole light-emitting area and the brightness of the pinhole light-emitting area comprises:

obtaining the brightness of the light of the first color allocated to the pixel unit by multiplying the brightness weight of the light of the first color in the pixel unit by the brightness of the pinhole light-emitting area.

6. The method according to claim 2, wherein the obtaining the actual brightness of the light of the first color in the pixel unit based on the brightness and color coordinate of the light of the first color allocated to the pixel unit from the pinhole light-emitting area and the brightness and color coordinate of the first sub-pixel light-emitting area in the pixel unit comprises:

calculating the actual brightness of the light of the first color in the pixel unit according to the following formulae:

$$\begin{pmatrix} L(h) \\ L(g1) \\ L(g2) \end{pmatrix} = \begin{pmatrix} Ghx & G1x & G2x \\ Ghy & G1y & G2y \\ Ghz & G1z & G2z \end{pmatrix}^{-1} = \begin{pmatrix} X1 \\ Y1 \\ Z1 \end{pmatrix}$$

$$Ghx = \frac{xh}{yh};\ Ghy = 1;\ Ghz = \frac{1 - xh - yh}{yh};$$

$$G1x = \frac{x1}{y1};\ G1y = 1;\ G1z = \frac{1 - x1 - y1}{y1};$$

$$G2x = \frac{x1}{y1};\ G2y = 1;\ G2z = \frac{1 - x1 - y1}{y1};$$

wherein L(h) represents the brightness of the light of the first color allocated to the pixel unit from the pinhole light-emitting area; L(g1) represents the brightness of part of the first sub-pixel light-emitting area L(g2) represents the brightness of other parts of the first sub-pixel light-emitting area, and the sum of L(g1) and L(g2) is equal to the brightness of the first sub-pixel light-emitting area; (xh, yh) represents the color coordinate of the light of the first color allocated to the pixel unit from the pinhole light-emitting area; (x1, y1) represents the color coordinate of the first sub-pixel light-emitting area; and X1, Y1 and Z1 represent the tristimulus value of the light of the first color in the pixel unit, where Y1 is equal to the actual brightness of the light of the first color in the pixel unit.

7. The method according to claim 1, wherein the obtaining the standard brightness of the light of the first color in the pixel unit under the preset gray-scale white balance based on the color coordinates of the first sub-pixel light-emitting area, the second sub-pixel light-emitting area and the third sub-pixel light-emitting area comprises:

calculating the standard brightness of the light of the first color in the pixel unit under the preset gray-scale white balance according to the following formulae:

$$\begin{pmatrix} L(R) \\ L(G) \\ L(B) \end{pmatrix} = \begin{pmatrix} Rx & Gx & Bx \\ Ry & Gy & By \\ Rz & Gz & Bz \end{pmatrix}^{-1} = \begin{pmatrix} X2 \\ Y2 \\ Z2 \end{pmatrix}$$

$$Rx = \frac{xr}{yr};\ Ry = 1;\ Rz = \frac{1 - xr - yr}{yr};$$

$$Gx = \frac{xg}{yg};\ Gy = 1;\ Gz = \frac{1 - xg - yg}{yg};$$

$$Bx = \frac{xb}{yb};\ By = 1;\ Bz = \frac{1 - xb - yb}{yb};$$

wherein L(R) represents the standard brightness of the second sub-pixel light-emitting area under the preset gray-scale white balance; L(G) represents the standard brightness of the first sub-pixel light-emitting area under the preset gray-scale white balance; L(B) represents the standard brightness of the third sub-pixel light-emitting area under the preset gray-scale white balance; X2, Y2 and Z2 represent the tristimulus value of the preset gray-scale white light; (xr, yr) represents the color coordinate of the second sub-pixel light-emitting area; (xg, yg) represents the color coordinate of the first sub-pixel light-emitting area; and (xb, yip) represents the color coordinate of the third sub-pixel light-emitting area.

8. The method according to claim 1, wherein the comparing the actual brightness with the standard brightness of the pixel unit and changing the brightness of the first sub-pixel light-emitting area based on the magnitude relationship between the actual brightness and the standard brightness comprises:

comparing the actual brightness with the standard brightness of the pixel unit, and gradually increasing or decreasing the brightness of the first sub-pixel light-emitting area according to a preset brightness interval based on the magnitude relationship between the actual brightness and the standard brightness, until the actual brightness of the light of the first color in the pixel unit is equal to the standard brightness of the light of the first color thereof;

wherein when the actual brightness is greater than the standard brightness, the brightness of the first sub-pixel light-emitting area is gradually decreased according to the preset brightness interval, until the actual brightness of the light of the first color in the pixel unit is equal to the standard brightness of the light of the first color thereof; and when the actual brightness is less than the standard brightness, the brightness of the first sub-pixel light-emitting area is gradually increased according to the preset brightness interval, until the actual brightness of the light of the first color in the pixel unit is equal to the standard brightness of the light of the first color thereof.

9. The method according to claim 1, wherein the reacquiring the actual brightness of light of the first color in the pixel unit comprises:

obtaining the changed brightness of the pinhole light-emitting area based on the changed brightness of the first sub-pixel light-emitting area;

wherein the initial brightness of the first sub-pixel light-emitting area is L1, and the initial brightness of the pinhole light-emitting area is L2; and the changed brightness of the first sub-pixel light-emitting area is L3, and the changed brightness of the pinhole light-emitting area is L4=L2*L3/L1.

10. The method according to claim 1, further comprising:

obtaining the target brightness of the first sub-pixel light-emitting area under a plurality of gray-scales; and obtaining the target brightness of the first sub-pixel light-emitting area under any gray-scale by using interpolation method.

11. A light regulation device for a display panel, the display panel comprising a pinhole light-emitting area, a first sub-pixel light-emitting area, a second sub-pixel light-emitting area, and a third sub-pixel light-emitting area of different colors, wherein a light-emitting color of the pinhole light-emitting area and a light-emitting color of the first sub-pixel light-emitting area are both a first color, the light regulation device comprising a sensor, a processor, and a memory;

wherein the sensor is configured to obtain brightness and a color coordinate of the pinhole light-emitting area, brightness and a color coordinate of the first sub-pixel light-emitting area in any pixel unit around the pinhole light-emitting area, and color coordinates of the second sub-pixel light-emitting area and the third sub-pixel light-emitting area in the pixel unit; and the processor is configured to, through execution of program instructions stored in the memory, obtain actual brightness of light of the first color in the pixel unit, based on the brightness and color coordinate of the pinhole light-emitting area, the brightness and color coordinate of the first sub-pixel light-emitting area in the pixel unit, and relative position information of the pinhole light-emitting area and the pixel unit; obtain standard brightness of the light of the first color in the pixel unit under a preset gray-scale white balance, based on the color coordinates of the first sub-pixel light-emitting area, the second sub-pixel light-emitting area and the third sub-pixel light-emitting area; compare the actual brightness with the standard brightness of the pixel unit, change the brightness of the first sub-pixel light-emitting area based on a magnitude relationship between the actual brightness and the standard brightness, and reacquire the actual brightness of the light of the first color in the pixel unit, until the actual brightness of the light of the first color in the pixel unit is equal to the standard brightness of the light of the first color thereof; and obtain target brightness of the first sub-pixel light-emitting area under the preset gray-scale, wherein the target brightness of the first sub-pixel light-emitting area is the brightness of the first sub-pixel light-emitting area when the actual brightness of the light of the first color in the pixel unit is equal to the standard brightness of the light of the first color thereof.

12. The device according to claim 11, wherein the processor is further configured to:

obtain a brightness weight of the light of the first color allocated to the pixel unit from the pinhole light-emitting area, based on a distance between a brightness center of the pinhole light-emitting area and a brightness center of the pixel unit;

obtain the brightness of the light of the first color allocated to the pixel unit, based on the brightness weight of the light of the first color allocated to the pixel unit from the pinhole light-emitting area and the brightness of the pinhole light-emitting area, wherein the color coordinate of the light of the first color allocated to the pixel unit from the pinhole light-emitting area is the same as the color coordinate of the light of the first color of the pinhole light-emitting area; and obtain the actual brightness of the light of the first color in the pixel unit, based on the brightness and color coordinate of the light of the first color allocated to the pixel unit from the pinhole light-emitting area and the brightness and color coordinate of the first sub-pixel light-emitting area in the pixel unit.

13. The device according to claim 12, wherein the processor is further configured to:

determine a plurality of pixel units closest to the pinhole light-emitting area;

obtain the distance between the brightness center of the pinhole light-emitting area and the brightness center of each of the plurality of pixel units respectively; and obtain the brightness weight of the light of the first color allocated to any one of the plurality of pixel units from the pinhole light-emitting area, based on the distance between the brightness center of the pinhole light-emitting area and the brightness center of each of the plurality of pixel units, wherein the sum of the brightness weights of the light of the first color allocated to the plurality of pixel units is 1, and the distance from the brightness center of the pixel unit to the brightness center of the pinhole light-emitting area is proportional to the brightness weight of the light of the first color allocated to the pixel unit.

14. The device according to claim 12, wherein the first sub-pixel light-emitting area is a green light-emitting area, the second sub-pixel light-emitting area is a red light-emitting area, and the third sub-pixel light-emitting area is a blue light-emitting area;

the display panel comprises the plurality of first sub-pixel light-emitting areas, the plurality of second sub-pixel light-emitting areas, and the plurality of third sub-pixel light-emitting areas, the second sub-pixel light-emitting areas, the first sub-pixel light-emitting areas, and the third sub-pixel light-emitting areas are alternately arranged along the same row, in the same row of pixel light-emitting areas, two first sub-pixel light-emitting areas distributed along a column direction are arranged between the second sub-pixel light-emitting area and the third sub-pixel light-emitting area, in adjacent rows of pixel light-emitting areas, the pixel light-emitting areas of the same color are not located in the same column, and in two rows of pixel light-emitting areas spaced one row apart, the pixel light-emitting areas of the same color are located in the same column;

the processor is further configured to:

determine three pixel units closest to the pinhole light-emitting area;

obtain the distance between the brightness center of the pinhole light-emitting area and the brightness center of each of the three pixel units respectively; and obtain the brightness weight of the light of the first color allocated to any one of the three pixel units from the pinhole light-emitting area, based on the distance between the brightness center of the pinhole light-emitting area and the brightness center of each of the three pixel units, wherein the sum of the brightness weights of the light of the first color allocated to the three pixel units is 1; and the distance from the brightness center of the pixel unit to the brightness center of the pinhole light-emitting area is proportional to the brightness weight of the light of the first color allocated to the pixel unit.

15. The device according to claim 12, wherein the processor is further configured to:

calculate the actual brightness of the light of the first color in the pixel unit according to the following formulae:

$$\begin{pmatrix} L(h) \\ L(g1) \\ L(g2) \end{pmatrix} = \begin{pmatrix} Ghx & G1x & G2x \\ Ghy & G1y & G2y \\ Ghz & G1z & G2z \end{pmatrix}^{-1} = \begin{pmatrix} X1 \\ Y1 \\ Z1 \end{pmatrix}$$

$$Ghx = \frac{xh}{yh};\ Ghy = 1;\ Ghz = \frac{1 - xh - yh}{yh};$$

$$G1x = \frac{x1}{y1};\ G1y = 1;\ G1z = \frac{1 - x1 - y1}{y1};$$

$$G2x = \frac{x1}{y1};\ G2y = 1;\ G2z = \frac{1 - x1 - y1}{y1};$$

wherein L(h) represents the brightness of the light of the first color allocated to the pixel unit from the pinhole light-emitting area; L(g1) represents the brightness of part of the first sub-pixel light-emitting area, L(g2) represents the brightness of other parts of the first sub-pixel light-emitting area, and the sum of L(g1,) and L(g2) is equal to the brightness of the first sub-pixel light-emitting area; (xh, yh) represents the color coordinate of the light of the first color allocated to the pixel unit from the pinhole light-emitting area; (x1, y1) represents the color coordinate of the first sub-pixel light-emitting area; and X1, Y1 and Z1 represent the tristimulus value of the light of the first color in the pixel unit, where Y1 is equal to the actual brightness of the light of the first color in the pixel unit.

16. The device according to claim 11, wherein the processor is further configured to:

calculate the standard brightness of the light of the first color in the pixel unit under the preset gray-scale white balance according to the following formulae:

$$\begin{pmatrix} L(R) \\ L(G) \\ L(B) \end{pmatrix} = \begin{pmatrix} Rx & Gx & Bx \\ Ry & Gy & By \\ Rz & Gz & Bz \end{pmatrix}^{-1} = \begin{pmatrix} X2 \\ Y2 \\ Z2 \end{pmatrix}$$

$$Rx = \frac{xr}{yr};\ Ry = 1;\ Rz = \frac{1 - xr - yr}{yr};$$

$$Gx = \frac{xg}{yg};\ Gy = 1;\ Gz = \frac{1 - xg - yg}{yg};$$

$$Bx = \frac{xb}{yb};\ By = 1;\ Bz = \frac{1 - xb - yb}{yb};$$

wherein L(R) represents the standard brightness of the second sub-pixel light-emitting area under the preset gray-scale white balance; L(G) represents the standard brightness of the first sub-pixel light-emitting area under the preset gray-scale white balance; L(B) represents the standard brightness of the third sub-pixel light-emitting area under the preset gray-scale white balance; X2, Y2 and Z2 represent the tristimulus value of the preset gray-scale white light; (xr, yr) represents the color coordinate of the second sub-pixel light-emitting area; (xg, yg) represents the color coordinate of the first sub-pixel light-emitting area; and (xh, yb) represents the color coordinate of the third sub-pixel light-emitting area.

17. The device according to claim 11, wherein the processor is further configured to:

compare the actual brightness with the standard brightness of the pixel unit, and gradually increasing or decreasing the brightness of the first sub-pixel light-emitting area according to a preset brightness interval based on the magnitude relationship between the actual brightness and the standard brightness, until the actual brightness of the light of the first color in the pixel unit is equal to the standard brightness of the light of the first color thereof;

wherein when the actual brightness is greater than the standard brightness; the brightness of the first sub-pixel light-emitting area is gradually decreased according to the preset brightness interval; until the actual brightness of the light of the first color in the pixel unit is equal to the standard brightness of the light of the first color thereof; and when the actual brightness is less than the standard brightness, the brightness of the first sub-pixel light-emitting area is gradually increased according to the preset brightness interval; until the actual brightness of the light of the first color in the pixel unit is equal to the standard brightness of the light of the first color thereof.

18. The device according to claim 11, wherein the processor is further configured to:

obtain the changed brightness of the pinhole light-emitting area based on the changed brightness of the first sub-pixel light-emitting area;

wherein the initial brightness of the first sub-pixel light-emitting area is L1, and the initial brightness of the pinhole light-emitting area is L2; and the changed brightness of the first sub-pixel light-emitting area is L3, and the changed brightness of the pinhole light-emitting area is L4=L2*L3/L1.

19. The device according to claim 11, wherein the processor is further configured to:

obtain the target brightness of the first sub-pixel light-emitting area under a plurality of gray-scales; and obtain the target brightness of the first sub-pixel light-emitting area under any gray-scale by using interpolation method.

20. A display panel, comprising a light regulation device, wherein the display panel further comprises a pinhole light-emitting area, a first sub-pixel light-emitting area, a second sub-pixel light-emitting area, and a third sub-pixel light-emitting area of different colors, wherein a light-emitting color of the pinhole light-emitting area and a light-emitting color of the first sub-pixel light-emitting area are both a first color, the light regulation device comprising a sensor, a processor and a memory;

wherein the sensor is configured to obtain brightness and a color coordinate of the pinhole light-emitting area, brightness and a color coordinate of the first sub-pixel light-emitting area in any pixel unit around the pinhole light-emitting area, and color coordinates of the second sub-pixel light-emitting area and the third sub-pixel light-emitting area in the pixel unit; and the processor is configured to, through executing a program stored in the memory, obtain actual brightness of light of the first color in the pixel unit, based on the brightness and color coordinate of the pinhole light-emitting area, the brightness and color coordinate of the first sub-pixel light-emitting area in the pixel unit, and relative position information of the pinhole light-emitting area and the pixel unit; obtain standard brightness of the light of the first color in the pixel unit under a preset gray-scale white balance; based on the color coordinates of the first sub-pixel light-emitting area, the second sub-pixel light-emitting area and the third sub-pixel light-emitting area; compare the actual brightness with the standard brightness of the pixel unit, change: the brightness of the first sub-pixel light-emitting area based on a magnitude relationship between the actual brightness and the standard brightness, and reacquire the actual brightness of the light of the first color in the pixel unit, until the actual brightness of the light of the first color in the pixel unit is equal to the standard brightness of the light of the first color thereof; and obtain target brightness of the first sub-pixel light-emitting area under the preset gray-scale, wherein the target brightness of the first sub-pixel light-emitting area is the brightness of the first sub-pixel light-emitting area when the actual brightness of the light of the first color in the pixel unit is equal to the standard brightness of the light of the first color thereof.

* * * * *